US008159342B1

(12) United States Patent
Medina, III et al.

(10) Patent No.: US 8,159,342 B1
(45) Date of Patent: Apr. 17, 2012

(54) SYSTEMS AND METHODS FOR WIRELESS OBJECT TRACKING

(75) Inventors: Reynaldo Medina, III, San Antonio, TX (US); Charles Lee Oakes, III, San Antonio, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 790 days.

(21) Appl. No.: 12/234,943

(22) Filed: Sep. 22, 2008

(51) Int. Cl.
*G08B 1/08* (2006.01)

(52) U.S. Cl. ..... 340/539.32; 340/539.13; 340/539.16; 340/539.21; 342/357.54; 455/456.1

(58) Field of Classification Search ..... 340/539.32, 340/539.13, 539.16, 539.21, 568.1, 573.1, 340/573.4; 342/357.54; 455/456.1
See application file for complete search history.

(56) References Cited

U.S. PATENT DOCUMENTS

| | | | | |
|---|---|---|---|---|
| 5,396,218 | A | 3/1995 | Olah | |
| 5,905,461 | A * | 5/1999 | Neher | 342/357.54 |
| 6,847,295 | B1 * | 1/2005 | Taliaferro et al. | 340/539.13 |
| 6,889,135 | B2 | 5/2005 | Curatolo et al. | |
| 6,891,471 | B2 | 5/2005 | Yuen et al. | |
| 7,015,817 | B2 | 3/2006 | Copley et al. | |
| 7,088,242 | B2 | 8/2006 | Aupperle et al. | |
| 7,164,354 | B1 | 1/2007 | Panzer | |
| 7,502,619 | B1 | 3/2009 | Katz | |
| 2002/0186135 | A1 * | 12/2002 | Wagner | 340/573.1 |
| 2002/0190861 | A1 * | 12/2002 | Wentworth | 340/568.1 |
| 2003/0151506 | A1 * | 8/2003 | Luccketti | 340/539.13 |
| 2004/0132461 | A1 * | 7/2004 | Duncan | 455/456.1 |
| 2004/0155775 | A1 * | 8/2004 | Kaneko | 340/539.21 |
| 2005/0200478 | A1 | 9/2005 | Koch et al. | |
| 2006/0181411 | A1 * | 8/2006 | Fast et al. | 340/539.13 |
| 2006/0232429 | A1 | 10/2006 | Gonzalez | |
| 2006/0238347 | A1 | 10/2006 | Parkinson et al. | |
| 2006/0255935 | A1 * | 11/2006 | Scalisi et al. | 340/539.13 |
| 2006/0290519 | A1 * | 12/2006 | Boate et al. | 340/573.4 |
| 2007/0285260 | A1 * | 12/2007 | Watanabe | 340/573.4 |

OTHER PUBLICATIONS

Brunette, W. et al. "Proximity Interactions between Wireless Sensors and their Application". Proceedings of the 2nd ACM international conference on Wireless sensor networks and applications. WSNA'03, Sep. 19, 2003, San Diego, California, USA. Copyright 2003 ACM 1-58113-764-8/03/0009. pp. 30-37.

* cited by examiner

*Primary Examiner* — George Bugg
*Assistant Examiner* — Sisay Yacob
(74) *Attorney, Agent, or Firm* — Brooks, Cameron & Huebsch, PLLC

(57) ABSTRACT

A system for object tracking may comprise at least one subsystem that couples an electronic signal emitting and receiving device to an object to be tracked, at least one subsystem that assigns an identifier to the object, at least one subsystem that registers the identifier of the object with a second object, and at least one subsystem that establishes electronic communication between the object to be tracked and the second object via the electronic signal emitting and receiving device. Also a system for object tracking may comprise at least one subsystem that detects at a first object an electronic signal from a second object, and at least one subsystem that emits an electronic alert beacon from the first object when said first object is determined to be out of range of the second object.

18 Claims, 8 Drawing Sheets

SYSTEMS AND METHODS FOR WIRELESS OBJECT TRACKING

CROSS REFERENCE TO RELATED APPLICATIONS

The patent applications below (including the present patent application) are filed concurrently and share a common title and disclosure, each of which is hereby incorporated herein by reference in its entirety:

U.S. patent application Ser. No. 12/234,924; and

U.S. patent application Ser. No. 12/234,933.

BACKGROUND

Locating a stolen or lost item can be difficult, especially when the item moves out of the main home location. Typical homing beacons do not provide enough information in order to locate particular items quickly and often an owner of an item may not know it is lost or stolen for a very long time at which the item may be well out of range to detect its whereabouts through traditional technologies. There is a need for a system capable of locating and track these items in a timely and efficient manner.

In this regard, there is a need for systems and methods for wireless object tracking that overcomes shortcomings of the prior art.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

In consideration of the above-identified shortcomings of the art, systems and methods for object tracking are provided. For several embodiments, a system for object tracking may comprise at least one subsystem that couples an electronic signal emitting and receiving device to an object to be tracked, at least one subsystem that assigns an identifier to the object, at least one subsystem that registers the identifier of the object with a second object, and at least one subsystem that establishes electronic communication between the object to be tracked and the second object via the electronic signal emitting and receiving device. Also a system for object tracking comprise at least one subsystem that detects at a first object an electronic signal from a second object, and at least one subsystem that emits an electronic alert beacon from the first object when said first object is determined to be out of range of the second object.

Other advantages and features of the invention are described below.

BRIEF DESCRIPTION OF THE DRAWINGS

Wireless object tracking is further described with reference to the accompanying drawings in which.

DETAILED DESCRIPTION

Certain specific details are set forth in the following description and figures to provide a thorough understanding of various embodiments. Certain well-known details often associated with computing and software technology are not set forth in the following disclosure to avoid unnecessarily obscuring the various embodiments. Further, those of ordinary skill in the relevant art will understand that they can practice other embodiments without one or more of the details described below. Finally, while various methods are described with reference to steps and sequences in the following disclosure, the description as such is for providing a clear implementation of various embodiments, and the steps and sequences of steps should not be taken as required to practice the embodiments.

Figure 1:
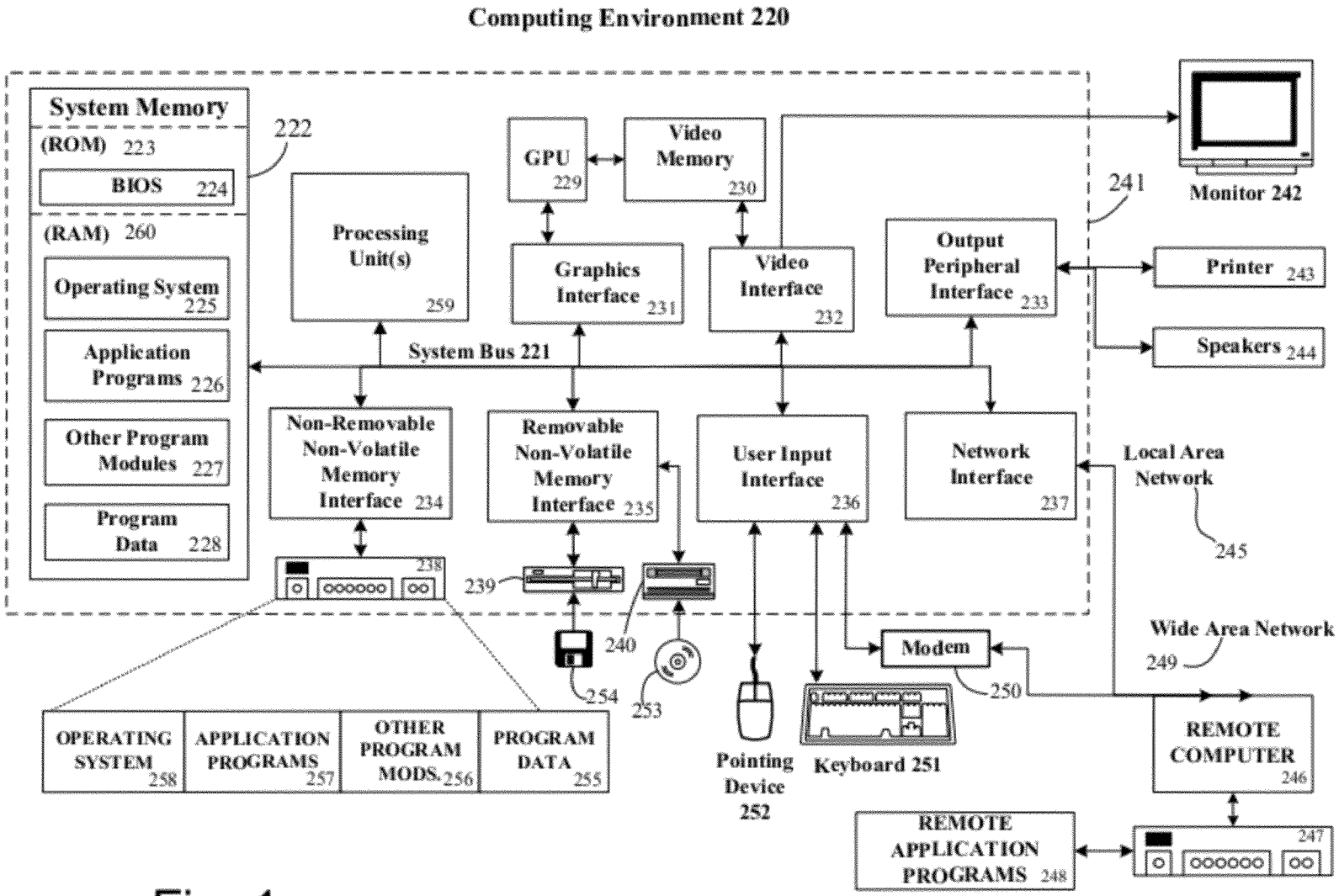
FIG. 1 is a block diagram representing an exemplary computing device suitable for use in conjunction with implementing wireless object tracking.

Referring next to FIG. 1, shown is a block diagram representing an exemplary computing device suitable for use in conjunction with implementing the processes described below. For example, the computer executable instructions that carry out the processes and methods for wireless object tracking may reside and/or be executed in such a computing environment as shown in FIG. 1. The computing system environment 220 is only one example of a suitable computing environment and is not intended to suggest any limitation as to the scope of use or functionality of the embodiments. Neither should the computing environment 220 be interpreted as having any dependency or requirement relating to any one or combination of components illustrated in the exemplary operating environment 220. For example a computer game console may also include those items such as those described below for use in conjunction with implementing the processes described below.

Aspects of the embodiments are operational with numerous other general purpose or special purpose computing system environments or configurations. Examples of well known computing systems, environments, and/or configurations that may be suitable for use with the embodiments include, but are not limited to, personal computers, server computers, handheld or laptop devices, multiprocessor systems, microprocessor-based systems, set top boxes, programmable consumer electronics, network PCs, minicomputers, mainframe computers, distributed computing environments that include any of the above systems or devices, and the like.

Aspects of the embodiments may be implemented in the general context of computer-executable instructions, such as program modules, being executed by a computer. Generally, program modules include routines, programs, objects, components, data structures, etc. that perform particular tasks or implement particular abstract data types. Aspects of the embodiments may also be practiced in distributed computing environments where tasks are performed by remote processing devices that are linked through a communications network. In a distributed computing environment, program modules may be located in both local and remote computer storage media including memory storage devices.

An exemplary system for implementing aspects of the embodiments includes a general purpose computing device in the form of a computer 241. Components of computer 241 may include, but are not limited to, a processing unit 259, a system memory 222, and a system bus 221 that couples various system components including the system memory to the processing unit 259. The system bus 221 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 241 typically includes a variety of computer readable media. Computer readable media can be any available media that can be accessed by computer 241 and include both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by computer 241. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory 222 includes computer storage media in the form of volatile and/or nonvolatile memory such as read only memory (ROM) 223 and random access memory (RAM) 260. A basic input/output system 224 (BIOS), containing the basic routines that help to transfer information between elements within computer 241, such as during start-up, is typically stored in ROM 223. RAM 260 typically contains data and/or program modules that are immediately accessible to and/or presently being operated on by processing unit 259. By way of example, and not limitation, FIG. 1 illustrates operating system 225, application programs 226, other program modules 227, and program data 228.

The computer 241 may also include other removable/non-removable, volatile/nonvolatile computer storage media. By way of example only, FIG. 1 illustrates a hard disk drive 238 that reads from or writes to non-removable, nonvolatile magnetic media, a magnetic disk drive 239 that reads from or writes to a removable, nonvolatile magnetic disk 254, and an optical disk drive 240 that reads from or writes to a removable, nonvolatile optical disk 253 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 238 is typically connected to the system bus 221 through an non-removable memory interface such as interface 234, and magnetic disk drive 239 and optical disk drive 240 are typically connected to the system bus 221 by a removable memory interface, such as interface 235.

The drives and their associated computer storage media discussed above and illustrated in FIG. 1, provide storage of computer readable instructions, data structures, program modules and other data for the computer 241. In FIG. 1, for example, hard disk drive 238 is illustrated as storing operating system 258, application programs 257, other program modules 256, and program data 255. Note that these components can either be the same as or different from operating system 225, application programs 226, other program modules 227, and program data 228. Operating system 258, application programs 257, other program modules 256, and program data 255 are given different numbers here to illustrate that, at a minimum, they are different copies. A user may enter commands and information into the computer 241 through input devices such as a keyboard 251 and pointing device 252, commonly referred to as a mouse, trackball or touch pad. Other input devices (not shown) may include a microphone, joystick, game pad, satellite dish, scanner, or the like. These and other input devices are often connected to the processing unit 259 through a user input interface 236 that is coupled to the system bus, but may be connected by other interface and bus structures, such as a parallel port, game port or a universal serial bus (USB). A monitor 242 or other type of display device is also connected to the system bus 221 via an interface, such as a video interface 232. In addition to the monitor, computers may also include other peripheral output devices such as speakers 244 and printer 243, which may be connected through a output peripheral interface 233.

The computer 241 may operate in a networked environment using logical connections to one or more remote computers, such as a remote computer 246. The remote computer 246 may be a personal computer, a server, a router, a network PC, a peer device or other common network node, and typically includes many or all of the elements described above relative to the computer 241, although only a memory storage device 247 has been illustrated in FIG. 1. The logical connections depicted in FIG. 1 include a local area network (LAN) 245 and a wide area network (WAN) 249, but may also include other networks. Such networking environments are commonplace in offices, enterprise-wide computer networks, intranets and the Internet.

When used in a LAN networking environment, the computer 241 is connected to the LAN 245 through a network interface or adapter 237. When used in a WAN networking environment, the computer 241 typically includes a modem 250 or other means for establishing communications over the WAN 249, such as the Internet. The modem 250, which may be internal or external, may be connected to the system bus 221 via the user input interface 236, or other appropriate mechanism. In a networked environment, program modules depicted relative to the computer 241, or portions thereof, may be stored in the remote memory storage device. By way of example, and not limitation, FIG. 1 illustrates remote application programs 248 as residing on memory device 247. It will be appreciated that the network connections shown are exemplary and other means of establishing a communications link between the computers may be used.

It should be understood that the various techniques described herein may be implemented in connection with hardware or software or, where appropriate, with a combination of both. Thus, the methods and apparatus of the embodiments, or certain aspects or portions thereof, may take the form of program code (i.e., instructions) embodied in tangible media, such as floppy diskettes, CD-ROMs, hard drives, or any other machine-readable storage medium wherein, when the program code is loaded into and executed by a machine, such as a computer, the machine becomes an apparatus for practicing the embodiments. In the case of program code execution on programmable computers, the computing device generally includes a processor, a storage medium readable by the processor (including volatile and non-volatile memory and/or storage elements), at least one input device, and at least one output device. One or more programs that may implement or utilize the processes described in connection with the embodiments, e.g., through the use of an API, reusable controls, or the like. Such programs are preferably implemented in a high level procedural or object oriented programming language to communicate with a computer system. However, the program(s) can be implemented in assembly or machine language, if desired. In any case, the language may be a compiled or interpreted language, and combined with hardware implementations.

Although exemplary embodiments may refer to utilizing aspects of the embodiments in the context of one or more stand-alone computer systems, the embodiments are not so limited, but rather may be implemented in connection with any computing environment, such as a network or distributed computing environment. Still further, aspects of the embodiments may be implemented in or across a plurality of processing chips or devices, and storage may similarly be effected across a plurality of devices. Such devices might include personal computers, network servers, handheld devices, supercomputers, or computers integrated into other systems such as automobiles and airplanes.

Figure 2:
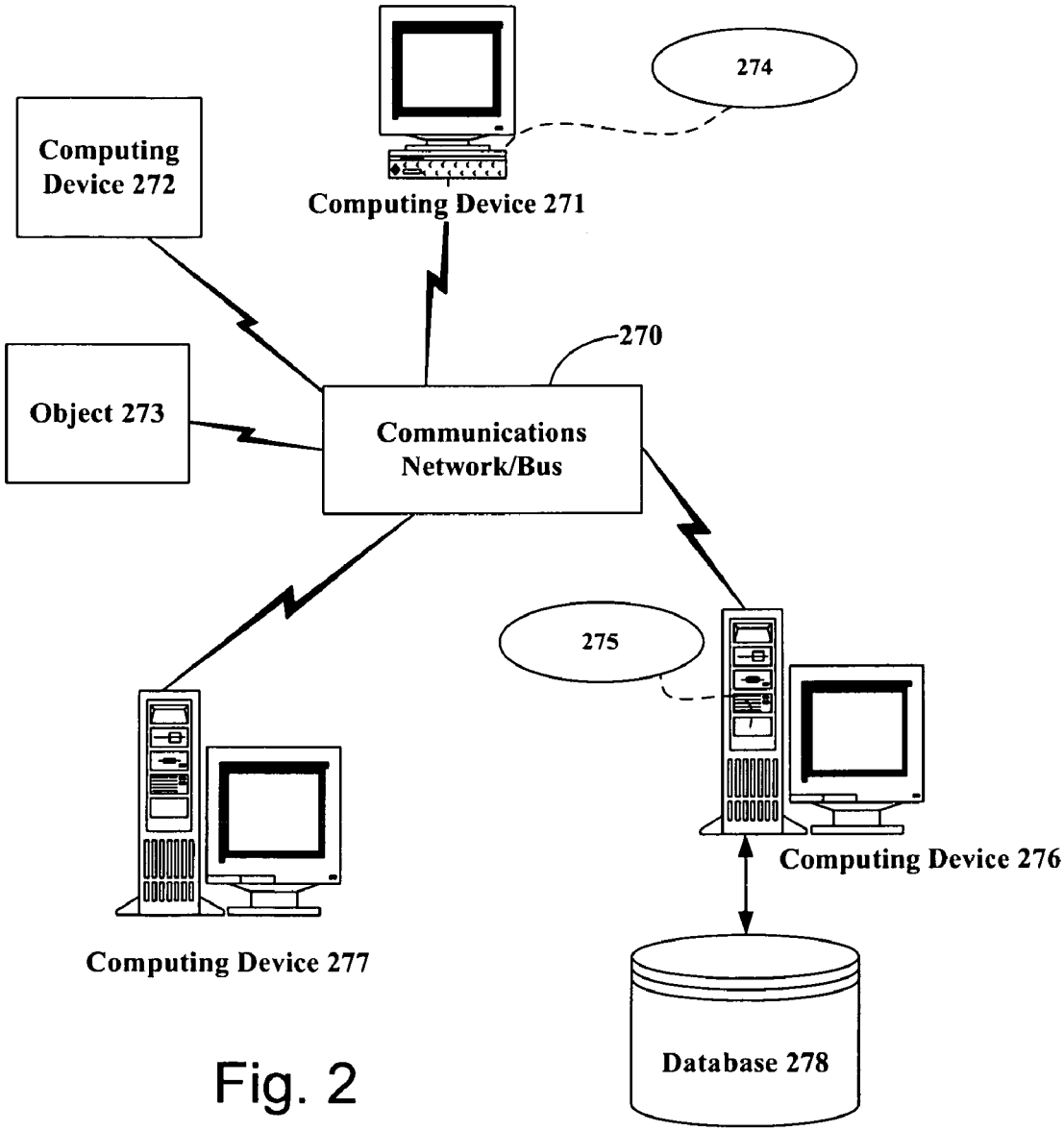
FIG. 2 illustrates an exemplary networked computing environment in which many computerized processes may be implemented to perform wireless object tracking.

Referring next to FIG. 2, shown is an exemplary networked computing environment in which many computerized processes may be implemented to perform the processes described below. For example, parallel computing may be part of such a networked environment with various clients on the network of FIG. 2 using and/or implementing wireless object tracking. One of ordinary skill in the art can appreciate that networks can connect any computer or other client or server device, or in a distributed computing environment. In this regard, any computer system or environment having any number of processing, memory, or storage units, and any number of applications and processes occurring simultaneously is considered suitable for use in connection with the systems and methods provided.

Distributed computing provides sharing of computer resources and services by exchange between computing devices and systems. These resources and services include the exchange of information, cache storage and disk storage for files. Distributed computing takes advantage of network connectivity, allowing clients to leverage their collective power to benefit the entire enterprise. In this regard, a variety of devices may have applications, objects or resources that may implicate the processes described herein.

FIG. 2 provides a schematic diagram of an exemplary networked or distributed computing environment. The environment comprises computing devices 271, 272, 276, and 277 as well as objects 273, 274, and 275, and database 278. Each of these entities 271, 272, 273, 274, 275, 276, 277 and 278 may comprise or make use of programs, methods, data stores, programmable logic, etc. The entities 271, 272, 273, 274, 275, 276, 277 and 278 may span portions of the same or different devices such as PDAs, audio/video devices, MP3 players, personal computers, etc. Each entity 271, 272, 273, 274, 275, 276, 277 and 278 can communicate with another entity 271, 272, 273, 274, 275, 276, 277 and 278 by way of the communications network 270. In this regard, any entity may be responsible for the maintenance and updating of a database 278 or other storage element.

This network 270 may itself comprise other computing entities that provide services to the system of FIG. 2, and may itself represent multiple interconnected networks. In accordance with an aspects of the embodiments, each entity 271, 272, 273, 274, 275, 276, 277 and 278 may contain discrete functional program modules that might make use of an API, or other object, software, firmware and/or hardware, to request services of one or more of the other entities 271, 272, 273, 274, 275, 276, 277 and 278.

It can also be appreciated that an object, such as 275, may be hosted on another computing device 276. Thus, although the physical environment depicted may show the connected devices as computers, such illustration is merely exemplary and the physical environment may alternatively be depicted or described comprising various digital devices such as PDAs, televisions, MP3 players, etc., software objects such as interfaces, COM objects and the like.

There are a variety of systems, components, and network configurations that support distributed computing environments. For example, computing systems may be connected together by wired or wireless systems, by local networks or widely distributed networks. Currently, many networks are coupled to the Internet, which provides an infrastructure for widely distributed computing and encompasses many different networks. Any such infrastructures, whether coupled to the Internet or not, may be used in conjunction with the systems and methods provided.

A network infrastructure may enable a host of network topologies such as client/server, peer-to-peer, or hybrid architectures. The "client" is a member of a class or group that uses the services of another class or group to which it is not related. In computing, a client is a process, i.e., roughly a set of instructions or tasks, that requests a service provided by another program. The client process utilizes the requested service without having to "know" any working details about the other program or the service itself. In a client/server architecture, particularly a networked system, a client is usually a computer that accesses shared network resources provided by another computer, e.g., a server. In the example of FIG. 2, any entity 271, 272, 273, 274, 275, 276, 277 and 278 can be considered a client, a server, or both, depending on the circumstances.

A server is typically, though not necessarily, a remote computer system accessible over a remote or local network, such as the Internet. The client process may be active in a first computer system, and the server process may be active in a second computer system, communicating with one another over a communications medium, thus providing distributed functionality and allowing multiple clients to take advantage of the information-gathering capabilities of the server. Any software objects may be distributed across multiple computing devices or objects.

Client(s) and server(s) communicate with one another utilizing the functionality provided by protocol layer(s). For example, HyperText Transfer Protocol (HTTP) is a common protocol that is used in conjunction with the World Wide Web (WWW), or "the Web." Typically, a computer network address such as an Internet Protocol (IP) address or other reference such as a Universal Resource Locator (URL) can be used to identify the server or client computers to each other. The network address can be referred to as a URL address. Communication can be provided over a communications medium, e.g., client(s) and server(s) may be coupled to one another via TCP/IP connection(s) for high-capacity communication.

In light of the diverse computing environments that may be built according to the general framework provided in FIG. 2 and the further diversification that can occur in computing in a network environment such as that of FIG. 2, the systems and methods provided herein cannot be construed as limited in any way to a particular computing architecture. Instead, the embodiments should be construed in breadth and scope in accordance with the appended claims.

Figure 3:
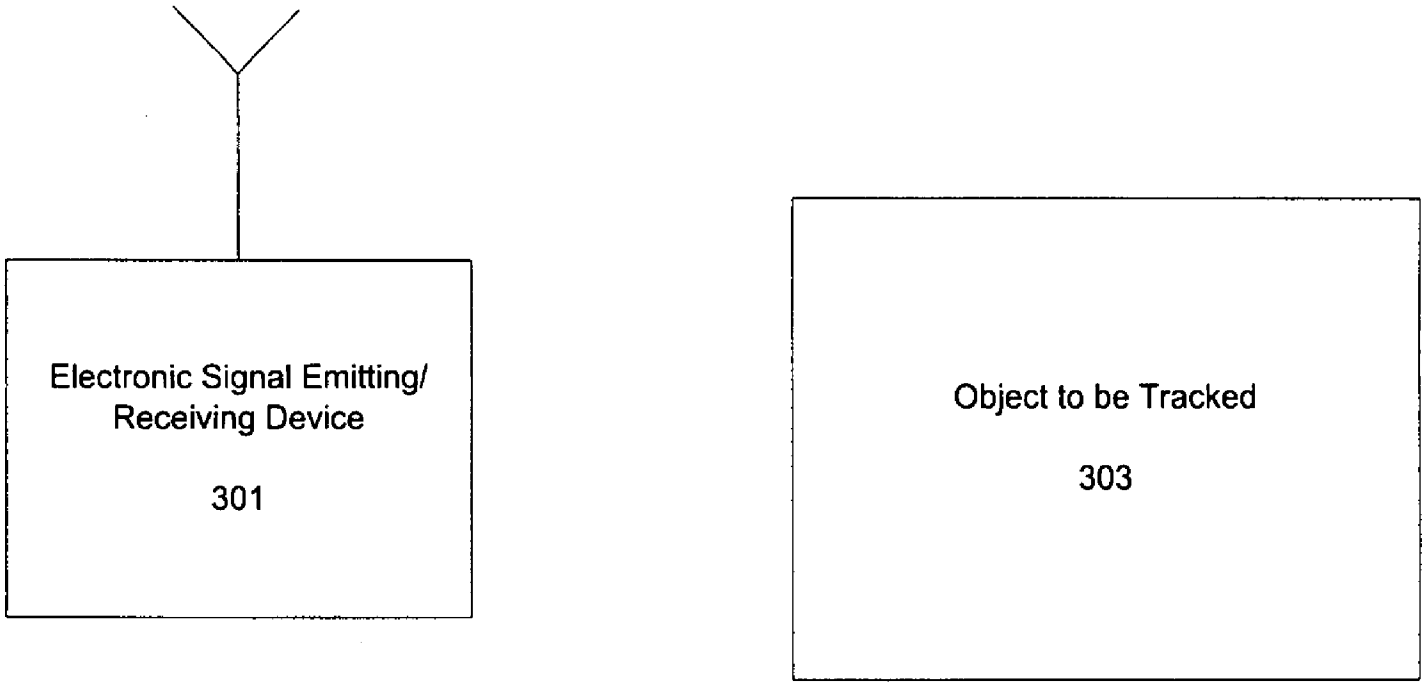
FIG. 3 is a block diagram illustrating a representation of an electronic signal emitting/receiving device and an object to be tracked.

Referring next to FIG. 3, shown is a block diagram illustrating a representation of an electronic signal emitting device and an object to be tracked. Shown are blocks representing an electronic signal emitting/receiving device 301 and an object to be tracked 303. The electronic signal emitting/receiving device 301 is a device that is capable of emitting one or more types of electronic signal(s) and/or receiving and processing one or more types of electronic signals. Examples of such devices include, but is not limited to radio frequency identification devices (RFID), radio transmitters and/or transceivers capable of transmitting and/or receiving including but not limited to one or more of the following types of signals and/or protocols: cellular network signals, Wi-Fi network signals, BlueTooth® signals, short or long range radio signals, RFID signals, infrared signals, sonic and ultrasonic signals, global positioning system (GPS) signals and other radio signals, optical and laser signals, and signals across any known spectrum of wavelengths and/or frequency.

The object to be tracked 303 may be any object to which the electronic emitting device 301 may be coupled. Examples include but are not limited to: personal items, computers, jewelry, clothes, automobiles, household goods, vehicles, objects of manufacture, people, animals, plants. For example, typically, the object to be tracked 303 will not be a stationary object since the location of stationary objects generally stays the same.

Figure 4:
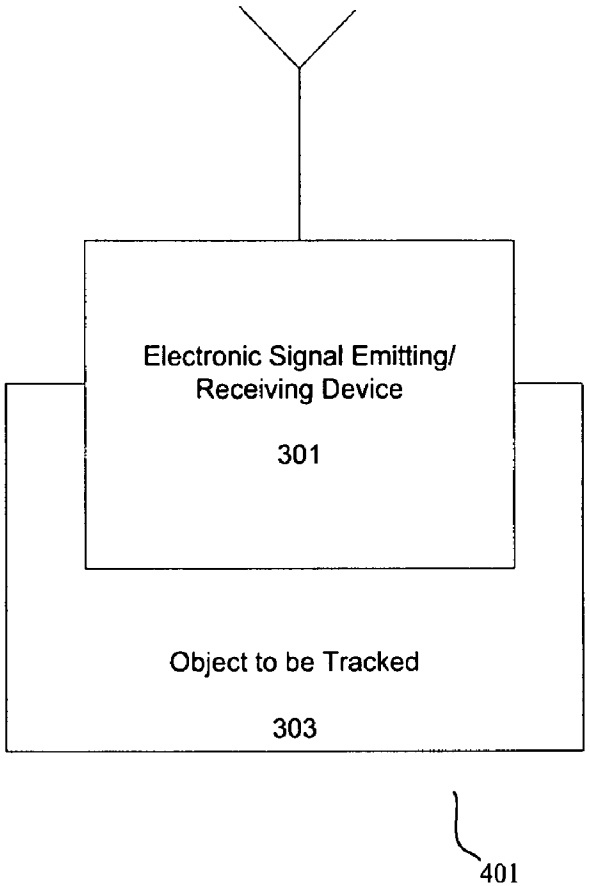
FIG. 4 is a block diagram illustrating a representation of an electronic signal emitting/receiving device coupled to an object to be tracked.

Referring next to FIG. 4, shown is a block diagram illustrating a representation of an electronic signal emitting/receiving device 301 coupled to an object to be tracked 303. When the electronic signal emitting/receiving device 301 is coupled to the object to be tracked 303, the two items may be referred to together as a single tracked object 401. The electronic signal emitting/receiving device 301 may be coupled to the object to be tracked 303 in any number of ways. For example, electronic signal emitting/receiving device 301 may be affixed to the object to be tracked 303 via adhesive material, tape, bolts, screws, wires, string, glue, Velcro, housed together in a common housing, etc. The electronic signal emitting/receiving device 301 may be affixed to the object to be tracked 303 in any such manner such that the electronic signal emitting/receiving device 301 may be used to track the object to be tracked 303.

Figure 5:
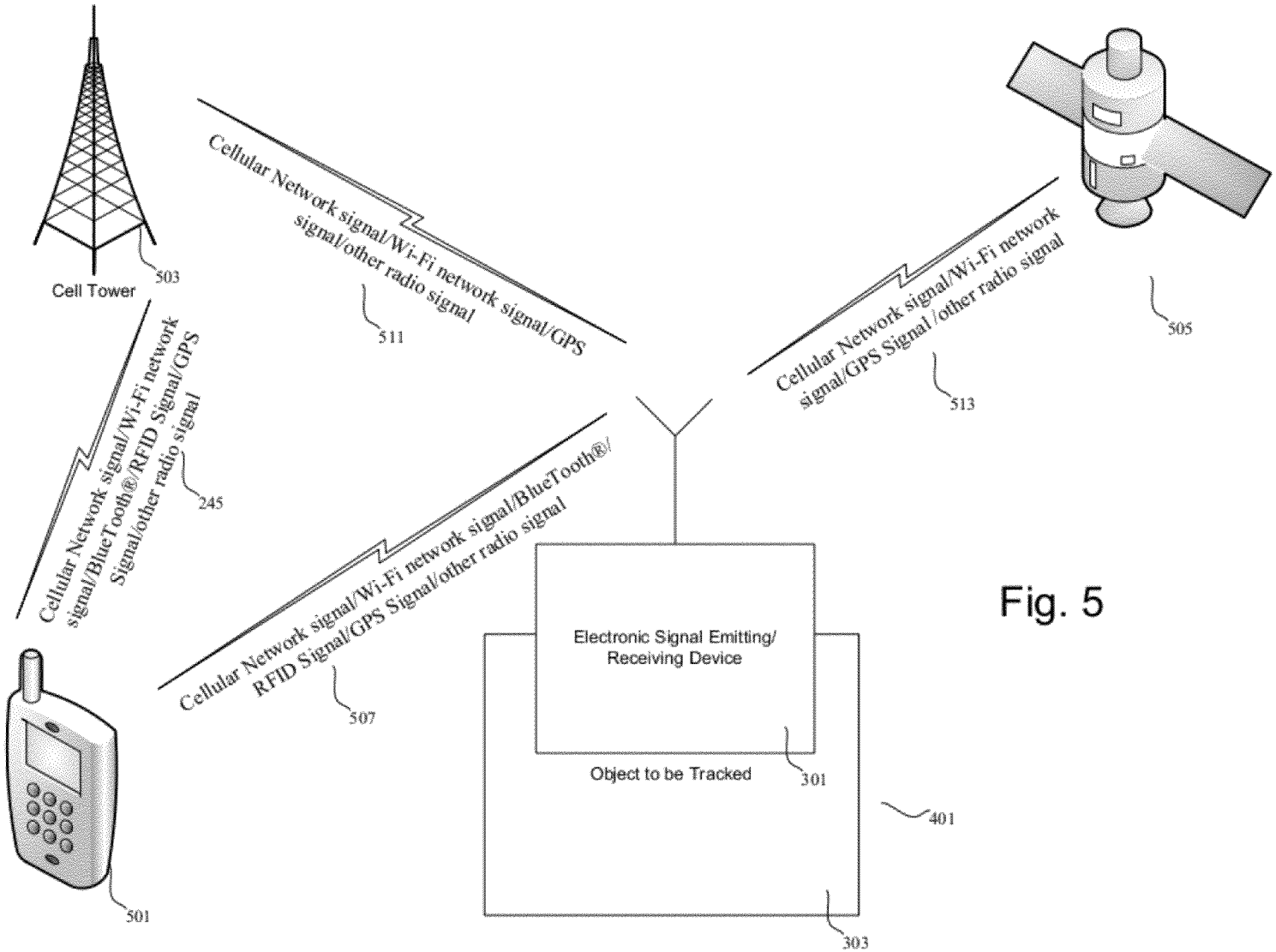
FIG. 5 is a block diagram illustrating an example system for wireless object tracking.

Referring next to FIG. 5, shown is a block diagram illustrating an example system for wireless object tracking Shown are examples of a tracked object 401, a "home" device with which the tracked object 401 is registered, an example cellular tower 503, an example satellite device 505. Also shown are representations of examples of a few various possible types of communication signals 507 509 511 513 between the example tracked object 401, the example "home" device with which the tracked object 401 is registered, the example cellular tower 503, and the example satellite device 505. For example, the communication signals 507 between the example tracked object 401 and the example "home" device may include but are not limited to one or more of the following: cellular network signals, Wi-Fi network signals, BlueTooth® signals, short or long range radio signals, RFID signals, infrared signals, sonic and ultrasonic signals, global positioning system (GPS) signals and other radio signals, optical and laser signals, and signals across any known spectrum of wavelengths and/or frequency. The satellite communication signals 507 between the example tracked object 401 and the example satellite device 513 may include but are not limited to signal intended for one or more of the following networks: cellular network, Wi-Fi network, GPS, other communications networks. Each device shown in FIG. 5 is equipped with the appropriate signal processing hardware and/or software and back end networking equipment to receive and send signals to communicate over the applicable network of choice.

Figure 6:
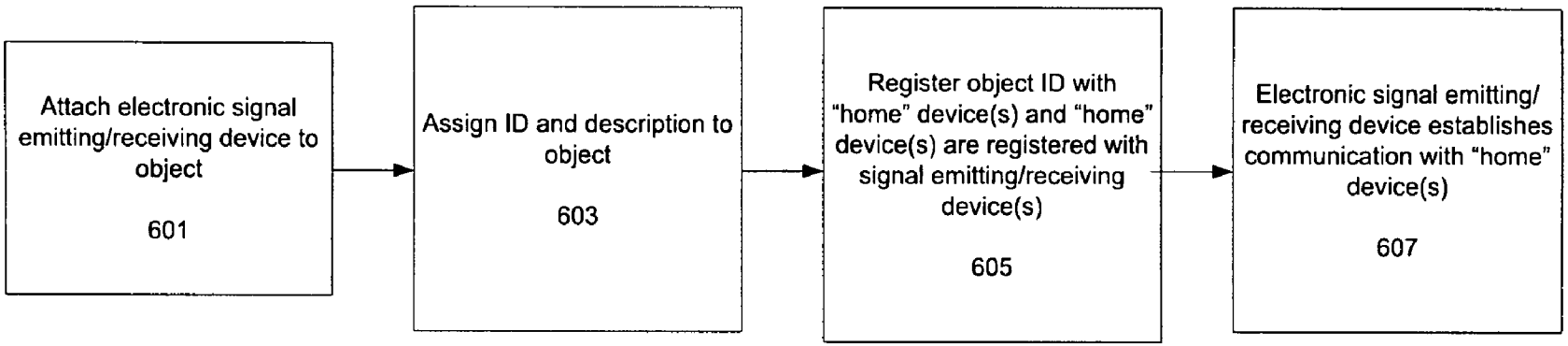
FIG. 6 is a flow chart illustrating an example process for device registration in a system for wireless object tracking.

Referring next to FIG. 6, shown is a flow chart illustrating an example process for device registration in a system for wireless object tracking. First, the electronic signal emitting/receiving device 301 may be coupled (601) to and object to be tracked 303. However, this step may not be necessary if the electronic signal emitting/receiving device 301 is already coupled (601) to the object to be tracked 303 (for example, if the objects 601 603 are already housed together is a case or housing of some sort). An identification number, name or code may be assigned (603) to the tracked object 401. Also other information regarding the tracked object 401 such as a description of the object 401, serial number, model number, owner name, etc. may be assigned (603) and stored in a memory of the tracked object 401 and/or the "home" device 501 with which the tracked object 401 will be registered. The object ID may be registered (605) with one or more "home" devices 501 and the "home" device(s) may be registered (605) with associated signal emitting/receiving device(s) 301 of the one or more objects to be tracked 401. In this way, the "home" device will know with which tracked object 401 it is communicating and the tracked object will know it is communicating with a correct "home" device. A "home" device 501 may have one or more tracked objects 401 registered with it and a tracked object may have one or more "home" devices 501 registered with it. The electronic signal emitting/receiving device(s) 301 of the tracked object(s) 401 may then establish (607) electronic communication with "home" device(s) 501 and vice versa. This communication may be via use of any number signals and network protocols including, but not limited to one or more of the following: cellular network signals, Wi-Fi network signals, BlueTooth® signals, short or long range radio signals, RFID signals, infrared signals, sonic and ultrasonic signals, global positioning system (GPS) signals and other radio signals, optical and laser signals, and signals across any known spectrum of wavelengths and/or frequency.

Figure 7:
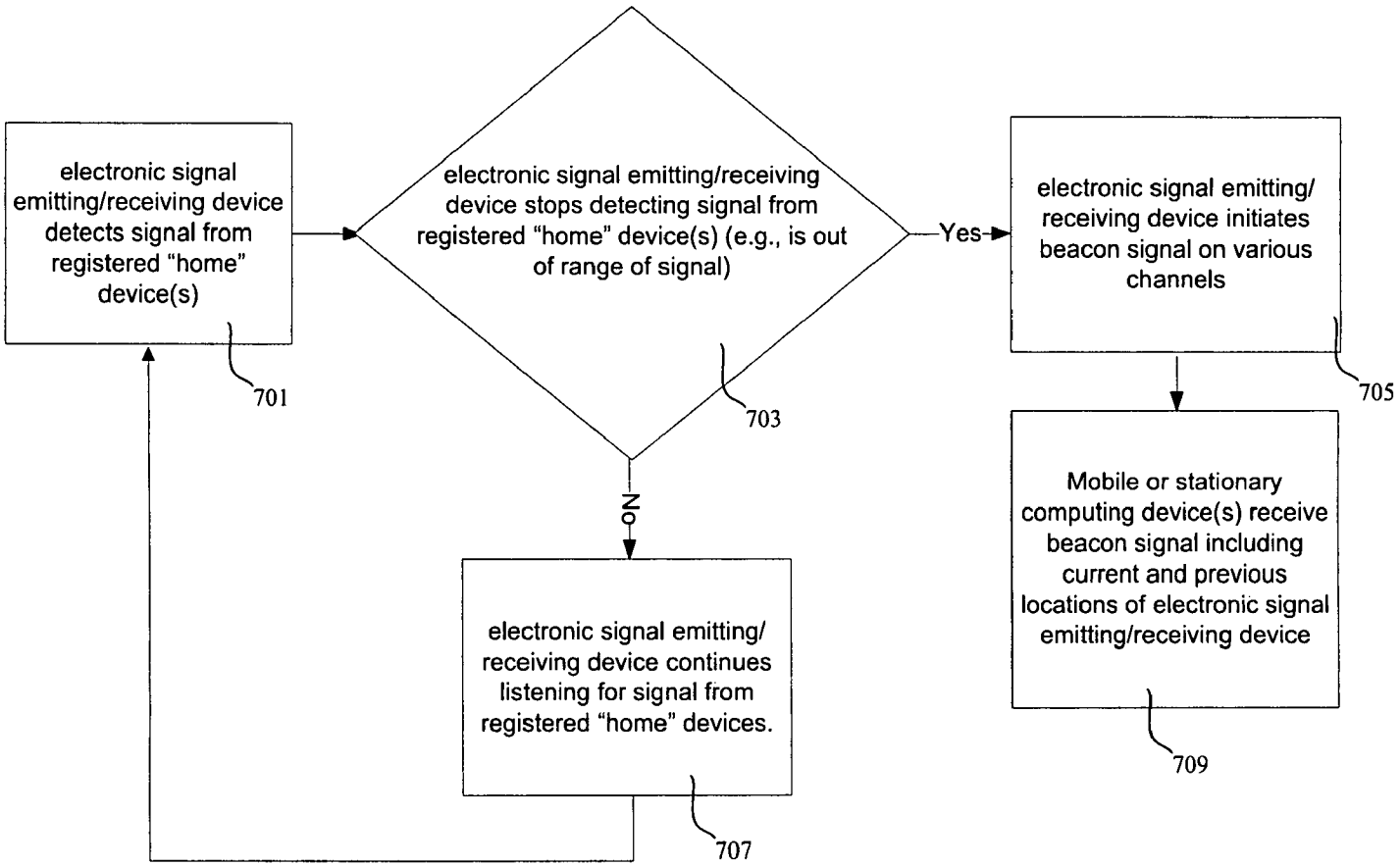
FIG. 7 is a flow chart illustrating an example process for implementing an object beacon alert in a system for wireless object tracking.

Referring next to FIG. 7, shown is a flow chart illustrating an example process for implementing an object beacon alert in a system for wireless object tracking. In one example, the electronic signal emitting/receiving device 301 or the tracked object 401 may detect a signal from one or more registered "home" device(s) 501. A home device 401, for example, may be any object of which the tracked object is intended to remain within a certain distance. For example, the home device may be (or may be coupled to) a cell phone, car, house, computer, clothing, purse, bag etc. It is then determined (703)

whether the electronic signal emitting/receiving device 301 has stopped detecting signal from a registered "home" device 501 (e.g., is out of range of the signal). This may indicate that the tracked object 401 is too far from the "home" device 501. Alternatively or in addition to loss of signal detection from the "home device" 501, location systems such as GPS and/or triangulation capabilities within the "home" device and/or the tracked object 401 may be used to indicate the tracked object is too far from the "home" device. If the electronic signal emitting/receiving device 301 stops detecting signal from a registered "home" device (e.g., is out of range of signal) or is otherwise determined to be too far (i.e., beyond a determined distance) from the "home device" the electronic signal emitting/receiving device may initiate (705) a beacon signal on various channels simultaneously or singularly. These channels may include, but are not limited to one or more of the following: cellular networks, Wi-Fi networks, BlueTooth® networks, short or long range radio networks, RFID networks, infrared networks, sonic and ultrasonic networks, global positioning system (GPS) networks and other radio networks, optical and laser networks, and networks across any known spectrum of wavelengths and/or frequency.

There may be multiple "home" devices 501 with which the tracked object 401 is registered and thus various rules programmed into the tracked object 401 for when to emit an alert beacon based upon which "home" devices, if any, the object is within range of. For example, the tracked object 401 may emit an alert beacon when outside the range of a particular "home" device 501 until it is within range again of that same "home" device 501, or when it is in range of another "home" device 501 with which the tracked 401 object is registered. Alternatively, the tracked object may be configured to continue to emit an alert beacon even when returning within range of a registered "home" device 501 when that registered "home" device 501 was not the original "home" device 501 from which it left. Alternatively, the tracked object 401 may be configured to continue to emit an alert beacon even when returning within range of the original registered "home" device 501 (e.g., to indicate that at one point in the past it had been out of range). There may also be various time limits set for when the alert beacon is to begin after the tracked object 401 leaves out of range, and for when it stops after the tracked object 401 returns in range of a "home" device.

The alert beacon may include various information including but not limited to current and previous location information of the tracked object 401, the time when the tracked object 401 went out of range, the time when the tracked object 401 came back in range (if any), the duration the tracked object 401 has been out of range, information about other registered or non-registered "home" devices 501 the tracked object 401 came within range of or detected, the duration and times the tracked object 401 was within range or out of range of other registered "home" devices. In such a case where there is electronic communication between the electronic signal emitting/receiving device 301 and the object to be tracked 303, the alert beacon may also include information about the use or tampering (if any) of tracked object 401 while it was out of range of the "home" device.

Signal receivers including those within mobile or stationary computing device(s) may receive and process (709) the alert beacon signal described above including the current and previous locations of the tracked object 401 and other information described above included in the transmitted alert beacon. This information may then be automatically sent, transmitted or relayed to alert and/or inform the owner or other interested or authorized parties of such information received. For example, an owner of a tracked object 401 that has been emitting an alert beacon may receive such an alert beacon and associated information on their wireless computing device or phone, through a satellite service to their television at home or computing device, through a Wi-Fi access point that had received the alert beacon, etc. There may also be a secure web site that a user may log onto and check to see if there has been any alert beacons received from any of their tracked objects 401, and through which channels the alert beacon(s) were received, if any.

Figure 8:
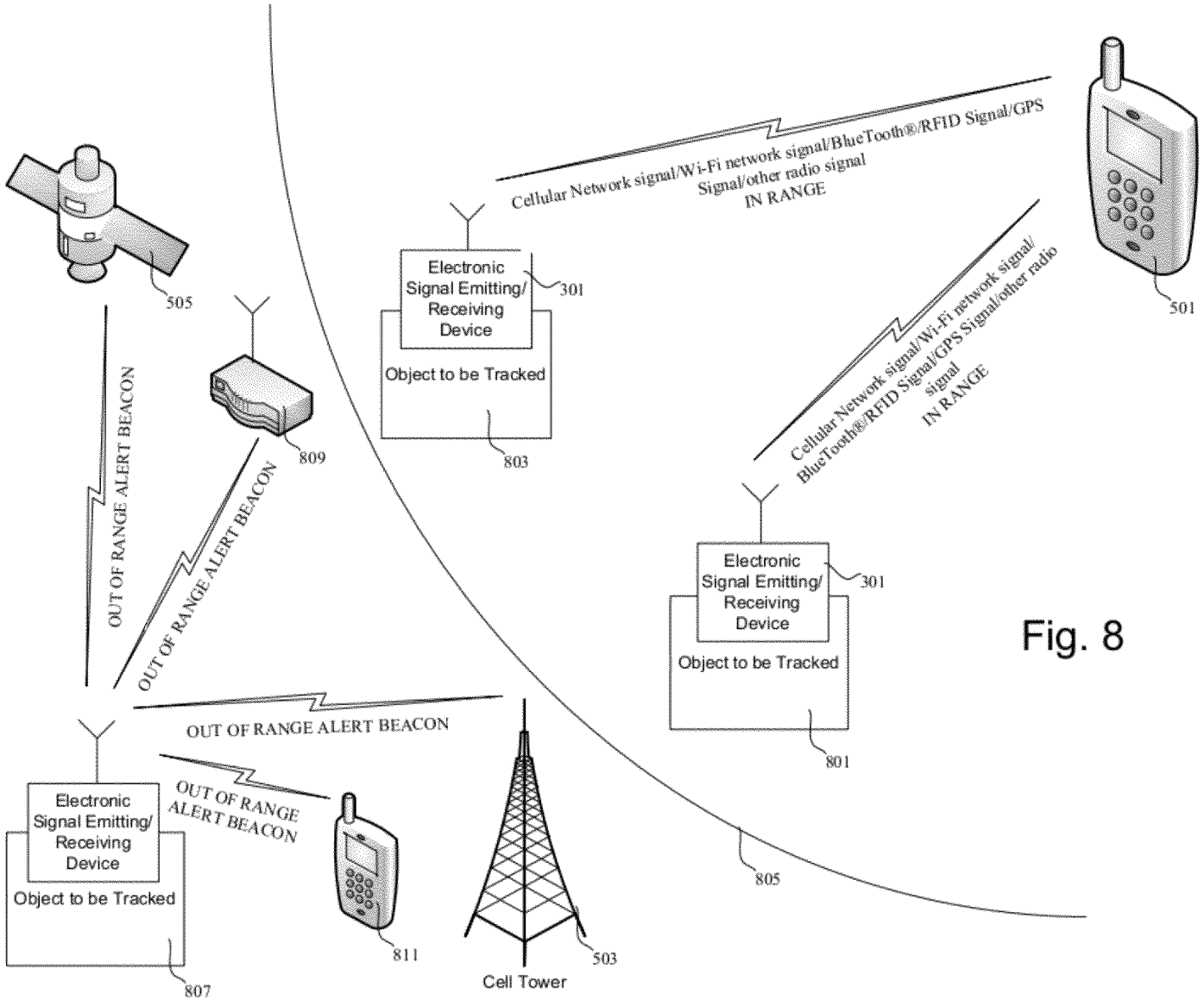
FIG. 8 is a block diagram illustrating an example scenario within a system for wireless object tracking wherein an object is emitting an object beacon alert.

Referring next to FIG. 8, shown is a block diagram illustrating an example scenario within a system for wireless object tracking wherein an object is emitting an object beacon alert. Shown is a registered "home" device 501 (as a mobile computing device in the present example) with two registered tracked objects 801 803 within a range 805 of the "home" device 501 shown. Notice that the two registered tracked objects 801 803 are in electronic communication with the "home" device in such a way at least for the electronic signal emitting/receiving devices 301 of the respective tracked objects 801 803 to determine whether the tracked objects 801 803 are within range of the "home" device. Since the two tracked objects 801 803 are within range of the "home" device 501, they are not emitting an out of range beacon.

However, tracked object 807 is outside the range 805 of the "home" device 501 and is consequently emitting an out of range alert beacon on multiple channels of communication including satellite 505, cellular channels 503, Wi-Fi networks 809, and other possible channels (represented by a receiver within a mobile computing device 811 shown in FIG. 8). Although not all shown in FIG. 8, channels through which the alert beacon may be sent and/or received include but are not limited to one or more of the following: cellular networks, Wi-Fi networks, BlueTooth® networks, short or long range radio networks, RFID networks, infrared networks, sonic and ultrasonic networks, global positioning system (GPS) networks and other radio networks, optical and laser networks, and networks across any known spectrum of wavelengths and/or frequency. Also, a user of the system may indicate which channels they would prefer the alert beacon to use via a programmable electronic signal emitting/receiving device 301 coupled to the tracked object 401.

It is noted that the foregoing examples have been provided merely for the purpose of explanation and are in no way to be construed as limiting of the present invention. While the invention has been described with reference to various embodiments, it is understood that the words which have been used herein are words of description and illustration, rather than words of limitations. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

The invention claimed is:

1. A system for object tracking comprising:

at least one subsystem of a first type that receives an electronic alert beacon from a first object when the first object is determined to be out of range of a second object, wherein the first object is out of range of the second object when the first object is unable to detect a signal from the second object and wherein the electronic alert beacon includes information regarding current and previous location information of the first object and information regarding the time at which the first object was out of range of the second object; and at least one subsystem of a second type that uses information in the received electronic alert beacon to aid in locating the first object.

2. The system of claim 1 wherein the at least one subsystem of the second type that uses information in the received electronic alert beacon comprises at least one subsystem of a third type that generates position data based upon different locations at which the electronic alert beacon was received.

3. The system of claim 1 wherein the location information comprises one or more of the following: GPS coordinates of at least one location of the first object while it was out of range of the second object, GPS coordinates of a current location of the first object.

4. The system of claim 1 wherein the electronic alert beacon is received by the second object.

5. The system of claim 1 further comprising at least one subsystem of a fourth type that provides a central interface that is automatically updated with information about electronic alert beacons received from the first object.

6. The system of claim 5 wherein the interface includes automatically updated location information of the first object based upon the electronic alert beacons received.

7. A method for object tracking comprising:

receiving an electronic alert beacon from a first object when the first object is determined to be out of range of the second object, wherein the first object is out of range of the second object when the first object is unable to detect a signal from the second object and wherein the electronic alert beacon includes information regarding current and previous location information of the first object and information regarding the time at which the first object was out of range of the second object; and using information in the received electronic alert beacon to aid in locating the first object.

8. The method of claim 7 wherein the using information in the received electronic alert beacon comprises generating position data based upon different locations at which the electronic alert beacon was received.

9. The method of claim 7 wherein the location information comprises one or more of the following: GPS coordinates of at least one location of the first object while it was out of range of the second object, GPS coordinates of a current location of the first object.

10. The method of claim 7 wherein the electronic alert beacon is received by the second object.

11. The method of claim 7 further comprising providing a central interface that is automatically updated with information about electronic alert beacons received from the first object.

12. The method of claim 11 wherein the interface includes automatically updated location information of the first object based upon the electronic alert beacons received.

13. A non-transitory computer readable medium for object tracking comprising computer readable instructions for:

receiving an electronic alert beacon from a first object when the first object is determined to be out of range of the second object, wherein the first object is out of range of the second object when the first object is unable to detect a signal from the second object and wherein the electronic alert beacon includes information regarding current and previous location information of the first object and information regarding the time at which the first object was out of range of the second object; and using information in the received electronic alert beacon to aid in locating the first object.

14. The computer readable medium of claim 13 wherein the computer readable instructions for using information in the received electronic alert beacon comprise computer readable instructions for generating position data based upon different locations at which the electronic alert beacon was received.

15. The computer readable medium of claim 13 wherein the location information comprises one or more of the following: GPS coordinates of at least one location of the first object while it was out of range of the second object, GPS coordinates of a current location of the first object.

16. The computer readable medium of claim 13 wherein the electronic alert beacon is received by the second object.

17. The computer readable medium of claim 13 further comprising computer readable instructions for providing a central interface that is automatically updated with information about electronic alert beacons received from the first object.

18. The computer readable medium of claim 17 further comprising computer readable instructions for automatically updating location information of the first object based upon the electronic alert beacons received.

* * * * *